US007128483B2

(12) United States Patent
Harada et al.

(10) Patent No.: US 7,128,483 B2
(45) Date of Patent: Oct. 31, 2006

(54) RIBBON CASSETTE WITH INK RIBBON SLACK PREVENTION MECHANISM

(75) Inventors: Hironori Harada, Chiryu (JP); Takashi Horiuchi, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 39 days.

(21) Appl. No.: 10/665,450

(22) Filed: Sep. 22, 2003

(65) Prior Publication Data

US 2004/0062586 A1 Apr. 1, 2004

(30) Foreign Application Priority Data

Sep. 27, 2002 (JP) ..... 2002-283278

(51) Int. Cl.
*B41J 35/28* (2006.01)

(52) U.S. Cl. ..... 400/234; 400/207; 400/242; 400/247

(58) Field of Classification Search ..... 400/234, 400/242, 247, 218–222; *B41J 33/52, 32/00*
See application file for complete search history.

(56) References Cited

U.S. PATENT DOCUMENTS

| | | | | |
|---|---|---|---|---|
| 4,074,799 | A * | 2/1978 | Hishida et al. | 400/208 |
| 4,521,125 | A | 6/1985 | Turbon | |
| 4,609,298 | A | 9/1986 | Shioda | |
| 4,798,486 | A * | 1/1989 | Kaneko | 400/208 |
| 4,983,058 | A * | 1/1991 | Nagae | 400/249 |
| 5,033,888 | A * | 7/1991 | Okumura et al. | 400/248 |
| 5,044,794 | A * | 9/1991 | Shimoyama et al. | 400/208 |
| 5,085,531 | A * | 2/1992 | Gillio | 400/234 |
| 5,240,201 | A * | 8/1993 | Gelardi et al. | 242/343 |
| 5,304,008 | A * | 4/1994 | Asakura et al. | 400/234 |
| 5,873,662 | A * | 2/1999 | Clevinger | 400/234 |

FOREIGN PATENT DOCUMENTS

| | | | |
|---|---|---|---|
| DE | 30 03 890 A1 | | 8/1981 |
| EP | 0 094 905 A1 | | 11/1983 |
| EP | 0344901 | * | 1/1989 |
| EP | 0 795 415 A1 | | 9/1997 |
| JP | A 08-25768 | | 1/1996 |
| JP | 08207403 | * | 8/1996 |
| WO | WO 97/47476 | | 12/1997 |

* cited by examiner

*Primary Examiner*—Daniel J. Colilla
*Assistant Examiner*—Marissa Ferguson-Samreth
(74) *Attorney, Agent, or Firm*—Oliff & Berridge, PLC

(57) ABSTRACT

A ribbon cassette includes a ribbon supply spool, and a ribbon take up spool that takes up an ink ribbon from the ribbon supply spool by rotating in a first rotation direction. The ribbon take up spool is provided with an engaging portion including first and second walls arranged in the second rotation direction in this order. The first wall is defined along a plane including a rotation axis of the ribbon take up spool. The second wall is inclined to face outside the ribbon take up spool. The ribbon cassette further includes an engaging member. The engaging member resiliently engages with the engaging portion by dropping into a space defined between the first and second walls and thereby prevents the ribbon take up spool from rotating in a second rotation direction opposite to the first rotation direction. The engaging member, however, comes off from the engaging portion when the ribbon take up spool rotates in the first direction.

34 Claims, 6 Drawing Sheets

RIBBON CASSETTE WITH INK RIBBON SLACK PREVENTION MECHANISM

BACKGROUND OF THE INVENTION

The present invention relates to a ribbon cassette, and more particularly to a ribbon cassette provided with a ribbon supply spool, on which an ink ribbon is wound, a ribbon take up spool for taking up the ink ribbon from the ribbon supply spool, and a simple mechanism for preventing slack in the ink ribbon.

Conventionally, many types of ribbon cassettes, each having a ribbon supply spool and a ribbon take up spool, are proposed. In such kind of ribbon cassettes, slack tends to occur in the ink ribbon since the ribbon supply spool is rotatably disposed in a ribbon cassette and no driving force is applied to the ribbon supply spool to regulate the rotation thereof. When the ribbon cassette is set into a printing device, the slack in the ink ribbon precludes suitable feeding of the ink ribbon from the ribbon cassette and hinders correct printing.

Japanese Patent Application Provisional Publication No. HEI 8-25768 discloses a ribbon cassette that is capable of avoiding the problem mentioned above. In the ribbon cassette disclosed in the above-mentioned publication, a clutch spring is provided to the ribbon supply spool, which applies a back tension to the ink ribbon to prevent slack from occurring therein.

In the meanwhile, the ribbon take up spool has not been considered as an object for providing a mechanism for preventing slack in the ink ribbon. This is because the ribbon take up spool is engaged with and rotated by a driving shaft of the printing device during the printing process and hence does not unintentionally rotate to cause slack in the ink ribbon.

The driving shaft of the printing device, however, often rotates more or less at the time the ribbon cassette is taken out from the printing device. Such a rotation of the driving shaft causes the ribbon take up spool to rotate and generate slack in the ink ribbon.

If the ribbon cassette is set into the printing device without removing the slack in the ink ribbon, the ink ribbon may be jammed within the ribbon cassette and make the ribbon cassette unusable. Thus, the slack in the ink ribbon, which may occur at the time the ribbon cassette is taken out from the printing device, should be removed in advance of setting again the ribbon cassette into the printing device. However, this is a burdensome procedure for a user and the user may often forget it. Even if the user has not forgotten to remove the slack in the ink ribbon, the user may rotate the ribbon take up spool in a direction opposite to that for taking up the ink ribbon, resulting in generating more slack in the ribbon.

Thus, there is a need for a ribbon cassette that is provided with a simple mechanism for preventing slack in the ink ribbon due to unintentional rotation of the ribbon take up spool.

SUMMARY OF THE INVENTION

The present invention is advantageous in that a ribbon cassette satisfying the above mentioned need is provided.

A ribbon cassette according to an aspect of the invention includes a ribbon supply spool, and a ribbon take up spool that takes up an ink ribbon from the ribbon supply spool by rotating in a first rotation direction. The ribbon take up spool is provided with an engaging portion. The ribbon cassette further includes an engaging member that resiliently engages with the engaging portion. By engaging with the engaging portion, the engaging member prevents the ribbon take up spool from rotating in a second rotation direction opposite to the first rotation direction, and hence prevents slack in the ink ribbon from occurring. The engaging member, however, comes off from the engaging portion when the ribbon take up spool rotates in the first direction. Accordingly, the ribbon take up spool can smoothly take up the ink ribbon from the ribbon supply spool.

In some cases, the engaging portion includes first and second walls arranged in the second rotation direction in this order, and the engaging member engages with the engaging portion by dropping into a space defined between the first and second walls. In such cases, the first wall may be defined along a plane including a rotation axis of the ribbon take up spool. The first wall configured as above does not allow the engaging member, which abuts against the first wall when the ribbon take up spool rotates in the second direction, from coming off from the engaging portion. The second wall may be formed so as to allow the engaging member to come off from the engaging portion by sliding along the second wall when the ribbon take up spool is rotated in the first rotation direction. For example, the second wall may be inclined to face outside the ribbon take up spool.

In some cases of the invention, the engaging portion is a slit formed through a cylindrical wall of the ribbon take up spool. In some particular cases, multiple slits are formed through the cylindrical wall so as to be arranged in a circumferential direction of the cylindrical wall. In such cases, the engaging member can engage with one of the slits before the ribbon take up spool rotates for a large angle in the second rotation direction. Thus, significant slack does not occur in the ink ribbon.

In some cases, the ribbon take up spool may be provided with a pair of brims and the ink ribbon may be wound around the ribbon take up spool at a space defined between the pair of brims. In such cases, the engaging portion may be located outside the pair of brims. In a ribbon cassette configured as above, one of the brims is located between the ink ribbon wound around the ribbon take up spool and the engaging portion and prevents the engaging member engaged with the engaging portion from interfering with the ink ribbon.

Optionally, a cassette case of the ribbon cassette, which accommodates the ribbon supply spool and the ribbon take up spool, may hold the engaging member to prevent it from rotating together with the ribbon take up spool. In this case, the engaging member can reliably prevent the ribbon take up spool from rotating in the second rotation direction.

The engaging member may be a single wire rod including an arc portion that extends along a circumferential wall of the ribbon take up spool, a linear portion formed at one end of the wire rod, and a bent portion defined between the arc portion and the linear portion so as to allow the linear portion to extend in substantially a radial direction of the ribbon take up spool. The engaging member configured as above can be engaged with the engaging portion at the bent portion thereof and held by the cassette case at the linear portion so as not to rotate together with the ribbon take up spool.

It should be noted that the cassette case may be provided with a groove, a pair of ribs, or a tube like portion for holding the engaging member.

Optionally, the engaging member may further include an additional linear portion formed between the bent portion and the arc portion, which is bent inwardly against the arc portion. Such a linear portion biases the engaging member toward the circumferential wall of the ribbon take up spool and thereby ensures the engaging member to engage with the engaging portion.

Optionally, the arc portion may be a major arc so that the arc portion can be stably mounted on the circumferential wall of the ribbon take up spool.

Optionally, the arc portion may have a smaller radius of curvature than the circumferential wall of the ribbon take up spool so as to be resiliently mounted on the circumferential wall.

Optionally, the ribbon take up spool may have a circumferential groove for receiving the arc portion of the engaging member. The circumferential groove prevents the arc portion from easily coming off from the ribbon take up spool. Further optionally, the arc portion may have a smaller radius of curvature than the circumferential groove so as to be resiliently mounted in the circumferential groove and does not come off therefrom easily.

In the case the ribbon take up spool is provided with the pair of brims, the circumferential groove and the arc portion may be located outside the pair of brims. In this case, the engaging member may further include an extending portion extending from an end of the arc portion opposite from the linear portion substantially along the radial direction of the ribbon take up spool. Such an extending portion prevents the engaging member from interfering with a burr formed on the brim and precluding smooth rotation of the ribbon take up spool.

BRIEF DESCRIPTION OF THE ACCOMPANYING DRAWINGS

Figure 1:
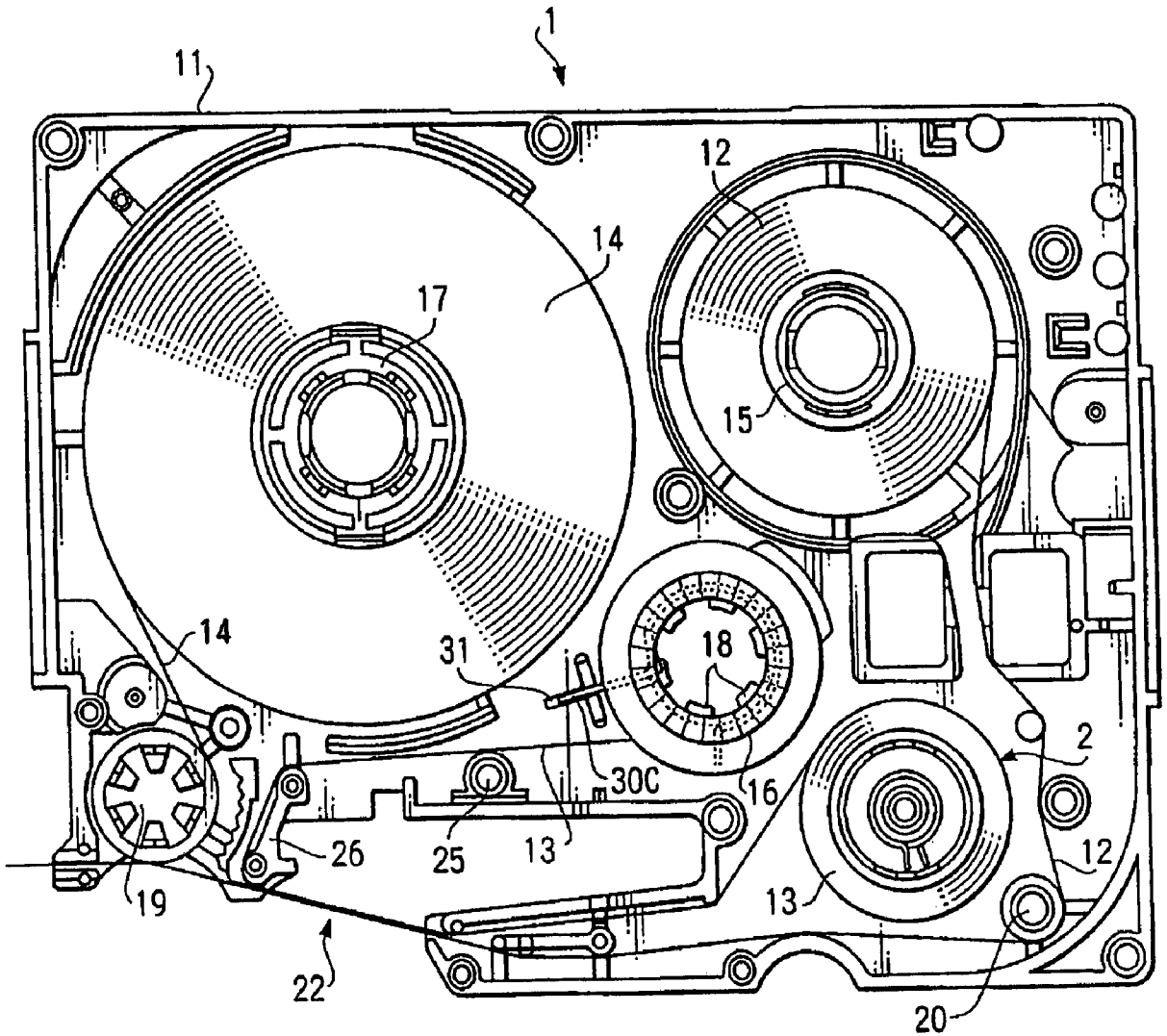
FIG. 1 shows an internal configuration of a tape cassette embodying the ribbon cassette according to an embodiment of the invention.
Figure 4:
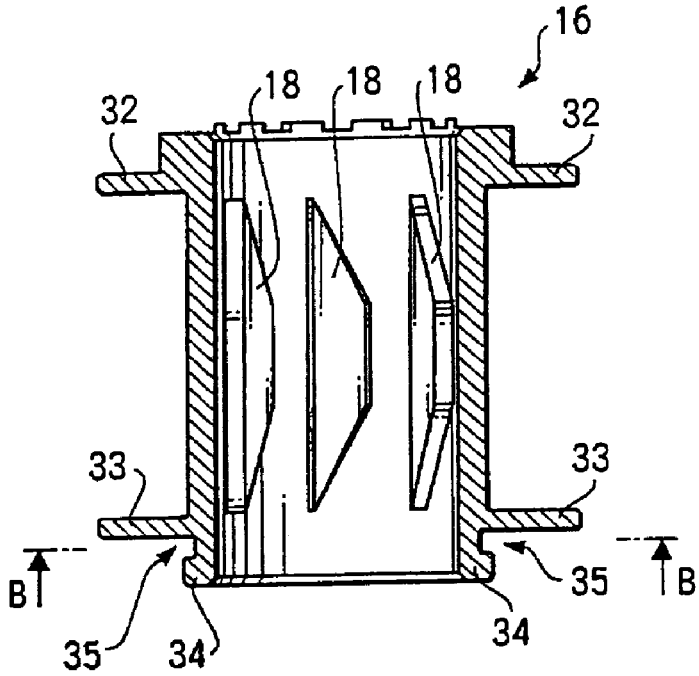
Figure 5:
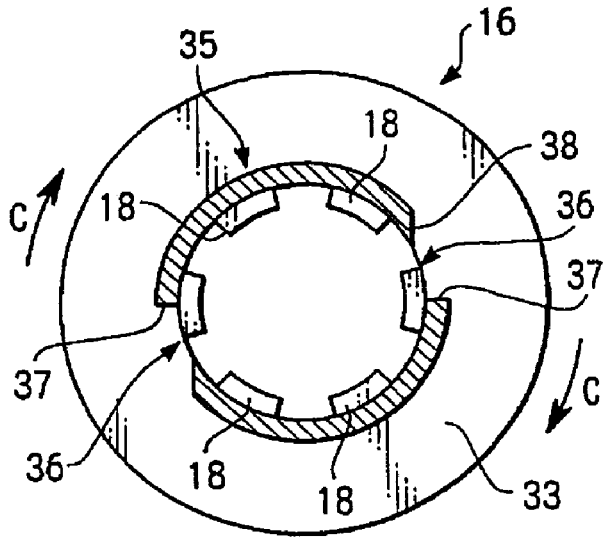
Figure 6:
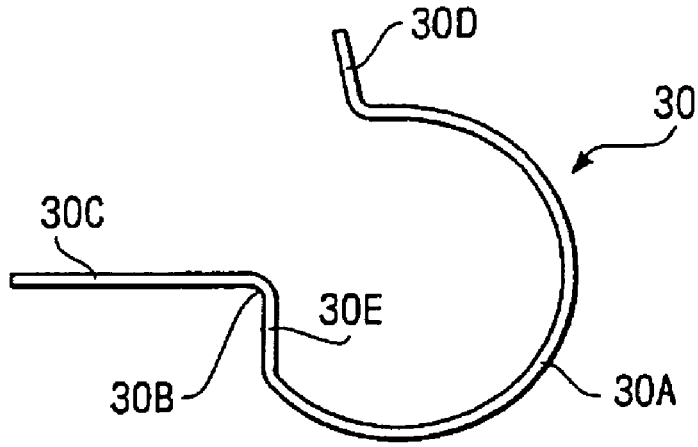
Figure 7:
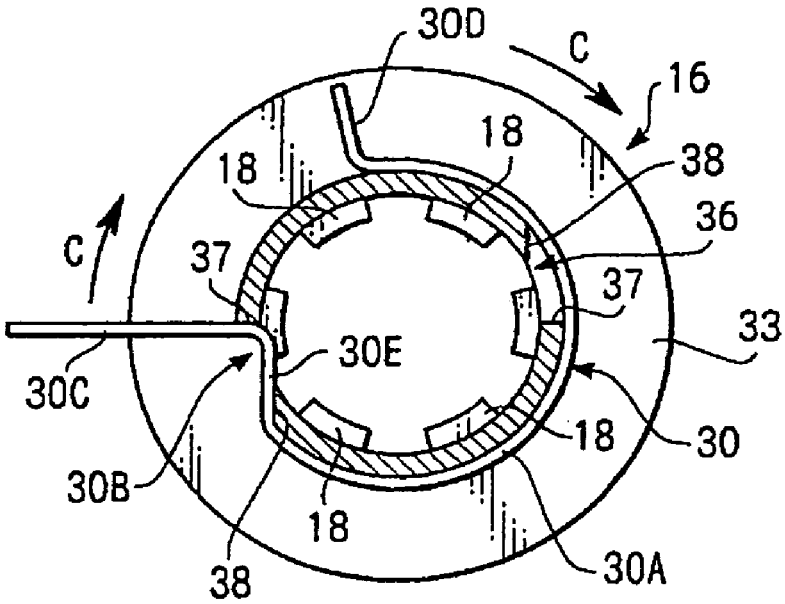
Figure 8:
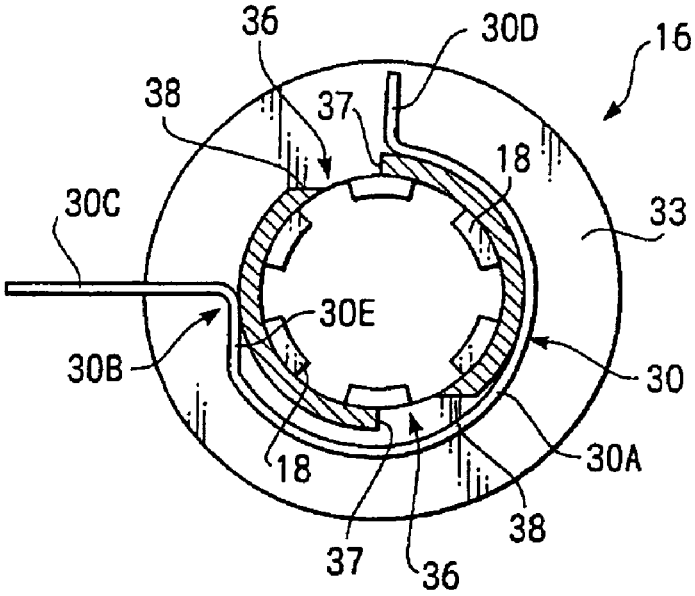
Figure 9:
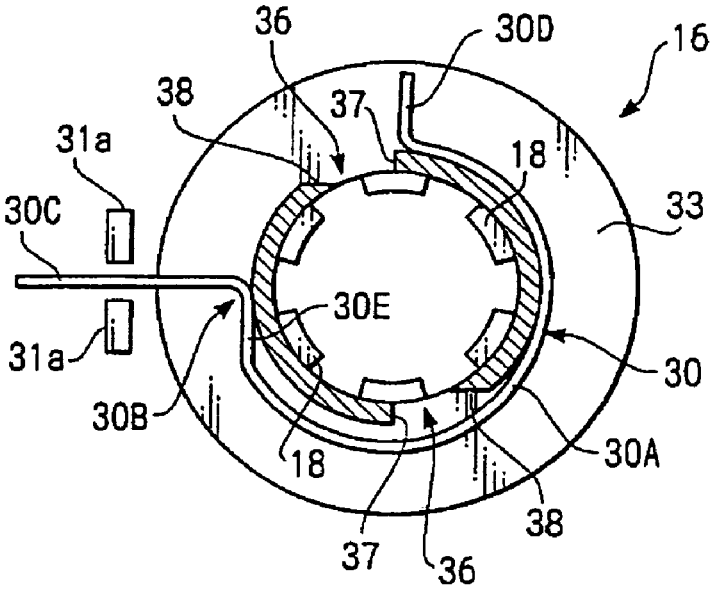
Figure 10:
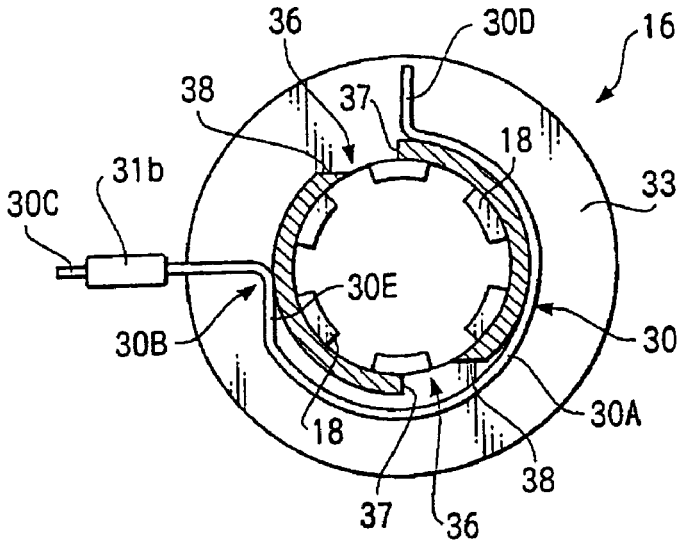
Figure 11:
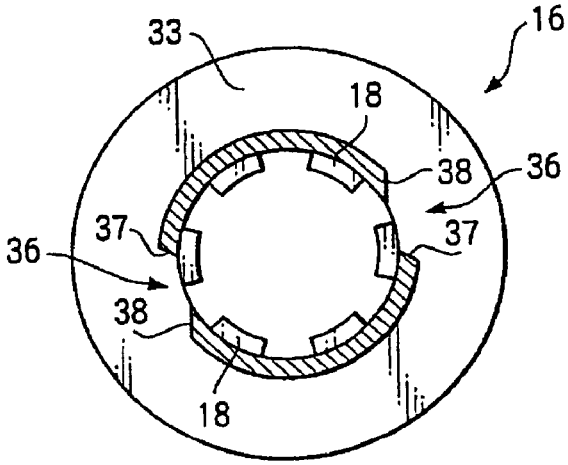
Figure 12:
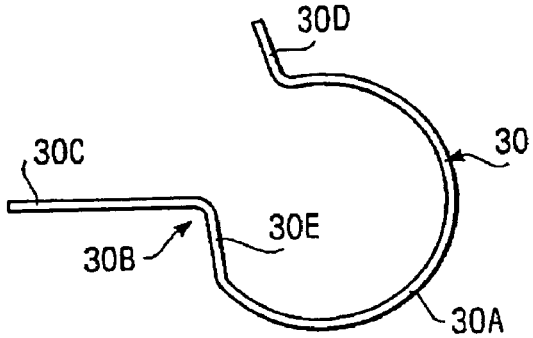

FIG. 4 schematically shows a sectional view of a ribbon take up spool of the cassette tape shown in FIG. 1;

FIG. 5 is a sectional view of the ribbon take up spool taken along a line B—B in FIG. 4;

FIG. 6 is a plane view of a spool spring of the tape cassette shown in FIG. 1;

FIG. 7 illustrates an anti-reverse rotation mechanism of the ribbon take up spool shown in FIG. 1 in which the spool spring is engaged with an engaging slit of the ribbon take up spool;

FIG. 8 shows a similar view to that of FIG. 7 in which the ribbon take up spool is rotated for an angle of 90° from the position shown in FIG. 7;

FIG. 9 is a similar view to that of FIG. 7 and illustrates a modification of an anti-reverse rotation mechanism of the ribbon take up spool;

FIG. 10 is a similar view to that of FIG. 7 and illustrates another modification of an anti-reverse rotation mechanism of the ribbon take up spool;

FIG. 11 is a sectional view similar to that of FIG. 5 illustrating a variation of the ribbon take up spool; and FIG. 12 is a plane view of a variation of a spool spring.

DETAILED DESCRIPTION OF THE EMBODIMENTS

Hereinafter, an embodiment of the invention will be described with reference to the accompanying drawings.

FIG. 1 shows an internal configuration of a tape cassette 1 embodying a ribbon cassette according to the embodiment of the invention. The tape cassette 1 is for use in a tape printing device (not shown) that prints on a long size print tape.

The tape cassette 1 includes a cassette case 11 made of resin, for example, and having a substantially rectangular parallelepiped form. Note that the cassette case 11 is composed of an upper part and a lower part and only the lower part is shown in FIG. 1. A clear tape 12, which is a medium to be printed, an ink ribbon 13 for printing on the clear tape 12, and a colored double-sided adhesive tape 14 to be adhered to the backside of the printed clear tape 12 are wound around respective spools and accommodated in the cassette case 11. A ribbon take up spool 16 for taking up the used ink ribbon 13 is also disposed in the cassette case 11.

The clear tape 12 accommodated in the cassette case 11 is wound around an clear tape spool 15. The clear tape 12 drawn out from the clear tape spool 15 passes by an auxiliary guide 20 and then through an opening 22 of the tape cassette 1. Then, the clear tape 12 is fed out from the tape cassette 1 by a tape driving roller 19, which is driven by the tape printing device (not shown).

The ink ribbon 13 accommodated in the cassette case 11 has one end thereof secured to an ribbon supply spool 2 and is wound around that ribbon supply spool 2. The ink ribbon 13 drawn out from the ribbon supply spool 2 is overlaid on the clear tape 12 and then passed through the opening 22 together with the clear tape 12. Then, the ink ribbon 13 is separated from the clear tape 12, passed by a ribbon guide 26 and an auxiliary guide 25 and extends up to the ribbon take up spool 16, which is rotatably driven by the tape printing device (not shown). The leading edge of the ink ribbon 13 is secured to the ribbon take up spool 16 so that the ink ribbon 13 can be wound therearound.

The ribbon take up spool 16 is provided with a plurality of protrusions, or inner teeth 18, formed along an inner circumferential wall thereof. The inner teeth 18 are engaged with an end portion of a driving shaft (not shown) of the tape printing device when the tape cassette 1 is set in the tape printing device. Thus, the ribbon take up spool 16 rotates as the driving shaft of the tape printing device rotates.

The colored double-sided adhesive tape 14 has a release coated paper attached on one side thereof and is wound around a double-sided tape spool 17 with the release coated paper located on the outer side thereof. The colored double-sided adhesive tape 14 drawn out from the double-sided tape spool 17 is laminated on the clear tape 12, when passing by the tape driving roller 19, at the adhesive side thereof or the side not provided with the release coated paper. Then the colored double-sided adhesive tape 14 is fed out from the tape cassette 1 together with the clear tape 12 by the tape driving roller 19.

When the tape cassette 1 is set in the tape printing device, a printing mechanism (not shown) of the tape printing device is located at the opening 22 of the tape cassette 1. The printing mechanism of the tape printing device includes a thermal head (not shown) and a platen roller (not shown). The platen roller presses the ink ribbon 13 and the clear tape 12 against the thermal head so that the thermal head can print on the clear tape 12. Note that the tape printing device can also rewind the ink ribbon 13 and the clear tape 12 for a small amount after each printing job in order to adjust the margin on the clear tape 12.

In the tape cassette 1 configured as above, the ribbon take up spool 16 is rotated by the driving force provided from the tape printing device via the inner teeth 18. The tape driving roller 19 is also rotated by the driving force provided from the tape printing device.

The tape printing device includes a driven roller (not shown) disposed so as to oppose with the tape driving roller 19. When the tape cassette is set in the tape printing device, the tape driving roller 19 and the driven roller sandwiches the clear tape 12 and the colored double-sided adhesive tape 14 laminated thereon.

As the tape driven roller 19 is rotated, the clear tape 12 and the colored double-sided adhesive tape 14 are drawn from the clear tape spool 15 and the double-sided tape spool 17, respectively. The clear tape spool 15 and the double-sided tape spool 17 respectively rotate in accordance with the lengths of the clear tape 12 and the colored double-sided adhesive tape 14 drawn from respective spools.

The ink ribbon 13 can be drawn out from the ribbon supply spool 2 by rotating the ribbon take up spool 16 in a counterclockwise direction in FIG. 1. The ribbon supply spool 2 rotates in the counterclockwise direction in accordance with the length of the ink ribbon 13 drawn from the ribbon supply spool 2.

Note that the tape printing device may be also configured such that the platen roller rotates in synchronization with the rotations of the ribbon take up spool 16 and the tape driving roller 19, and such that the ink ribbon 13 overlaid on the clear tape 12 and sandwiched between the thermal head and the platen roller is fed by the rotation of the platen roller and the fed portion of the ink ribbon 13 is taken up by the ribbon take up spool 16.

Figure 2:
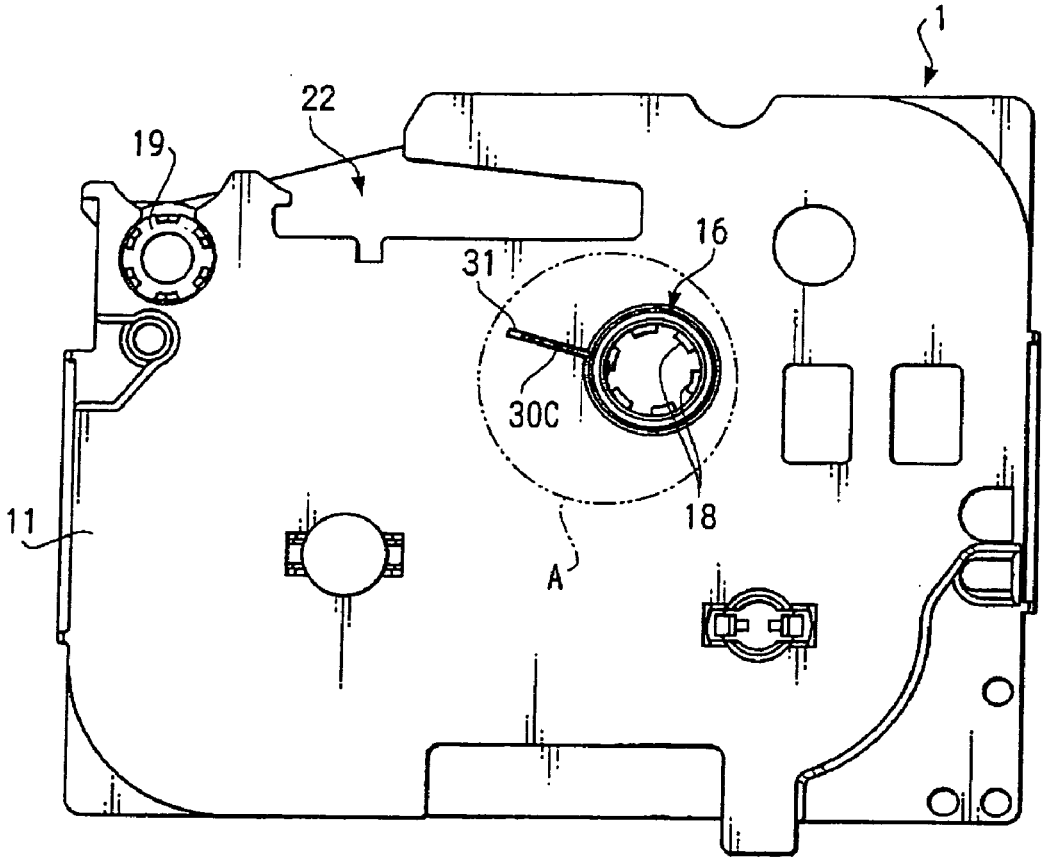
FIG. 2 is a plane view of an under surface of the tape cassette shown in FIG. 1.
Figure 3:
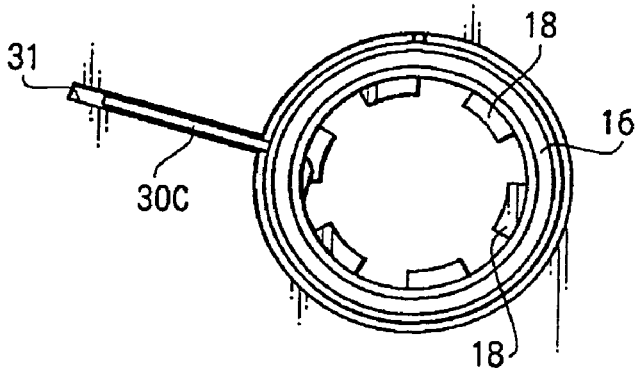
FIG. 3 is an enlarged view of a part of the tape cassette surrounded by a circle A in FIG. 2.

FIG. 2 is a plane view of the under surface of the tape cassette 1 shown in FIG. 1, and FIG. 3 is an enlarged view of a part of the tape cassette 1 surrounded by a circle A in FIG. 2.

As shown in FIG. 2, the cassette case 11 has an engaging groove 31 that is formed in a vicinity of the ribbon take up spool 16. The engaging groove 31 holds a first extending portion 30C of a spool spring 30. The spool spring 30 is mounted on the ribbon take up spool 16 and constitutes a part of an anti-reverse rotation mechanism of the ribbon take up spool 16. The engaging groove 31 holds the first extending portion 30C so as to prevent the spool spring 30 from rotating together with the ribbon take up spool 16. That is, the spool spring 30 held by the engaging groove 31 does not rotate in a ribbon take up direction C (see FIG. 5) and not in an opposite direction thereof, either.

Now, the anti-reverse rotation mechanism of the ribbon take up spool 16, which includes the spool spring 30 and the ribbon take up spool 16, will be described.

First, the configuration of the ribbon take up spool 16 will be described in detail. FIG. 4 schematically shows a sectional view of the ribbon take up spool 16 taken along a plane including a rotation axis thereof. FIG. 5 is a sectional view of the ribbon take up spool 16 taken along a line B—B in FIG. 4.

The ribbon take up spool 16 is a substantially hollow cylindrical member provided with the inner teeth 18 formed along the inner circumferential surface thereof, which inner teeth 18 are to be engaged with the end portion of the driving shaft of the tape printing device (not shown). The ribbon take up spool 16 is also provided with a pair of brims, or an upper brim 32 and a lower brim 33, that are integrally formed on the outer circumferential surface of the ribbon take up spool 16 in a vicinity of respective ends thereof. The ink ribbon 13 is wound around the ribbon take up spool 16 at a space defined between the pair of brims 32, 33. The pair of brims 32 and 33 respectively guide the upper and lower side edges of the ink ribbon 13 so that the ink ribbon 13 can be neatly wound around the ribbon take up spool 16.

The ribbon take up spool 16 is provided with a circumferential groove 35 formed on the outer circumferential surface between the lower brim 33 and the lower end 34 thereof, or outside the pair of brims 32 and 33. Two engaging portions, or engaging slits 36, are formed through the cylindrical wall of the ribbon take up spool 16 within the circumferential groove 35 so as to face each other. Each engaging slit 36 is formed such that a bent portion 30B of the spool spring 30, which will be described later, can resiliently engage therewith.

Each engaging slit 36 has first and second walls 37 and 38 arranged in this order in the direction opposite to the ribbon take up direction C. Note that the ribbon take up direction C coincides with the clockwise direction in FIG. 5, and the counterclockwise direction in FIG. 1. The first wall 37 is formed so as to extend in a radial direction of the ribbon take up spool 16, or defined on a plane including the rotation axis of the ribbon take up spool 16. Accordingly, the first wall 37 intersects perpendicularly with the outer circumferential surface of the ribbon take up spool 16. The second wall 38 is obliquely formed, or inclined, so as to face outside the ribbon take up spool 16.

Next, the configuration of the spool spring 30 will be described. FIG. 6 is a plane view of the spool spring 30. The spool spring 30 is formed from a single wire rod of which diameter is within the range of 0.35 mm to 0.5 mm. The spool spring 30 has an arc portion 30A, a first extending portion 30C, a bent portion 30B formed between the arc portion 30A and the first extending portion 30C, and a linear portion 30E extending between the arc portion 30A and the bent portion 30B.

The arc portion 30A is a major arc that is mounted on the outer circumferential surface of the ribbon take up spool 16 so as to be received in the circumferential groove 35. Note that the arc portion 30A is formed such that the radius of curvature thereof is smaller than that of the circumferential groove 35. Thus, the arc portion 30A is resiliently mounted in the circumferential groove 35 and does not come off therefrom easily.

The linear portion 30E is bent inwardly against the arc portion 30A, or bent toward the center of the arc portion 30A.

The bent portion 30B is the part of the spring spool 30 that engages with the engaging slits 36. Since the liner portion 30E is inclined inwardly against the arc portion 30A, the bent portion 30B is biased against the outer circumferential surface of the ribbon take up spool 16 and drops into the engaging slit 36 when the engaging slit 36 is located next to it. The bent portion 30B is bent at substantially a right angle.

As shown in FIGS. 2 and 3, the first extending portion 30C of the spool spring 30 extends in substantially a radial direction of the ribbon take up spool 16 when the spool spring 30 is mounted on the ribbon take up spool 16. The first extending portion 30C is inserted into the engaging groove 31 of the cassette case 11. Thus, the spring spool 30 does not rotate with the ribbon take up spool 16.

The spring spool 30 further includes a second extending portion 30D extending in substantially the radial direction of the ribbon take up spool 16 from the end of the arc portion 30A opposite from the first extending portion 30C.

Next, the operation of the anti-reverse rotation mechanism of the ribbon take up spool 16 will be described.

FIG. 7 shows the spool spring 30 engaged at a bent portion thereof with one of the engaging slits 36 of the ribbon take up spool 16. FIG. 8 shows a similar view to that of FIG. 7 in which the ribbon take up spool 16 is rotated for an angle of 90° from the position shown in FIG. 7.

In FIG. 7, the arc portion 30A of the spool spring 30 is resiliently mounted in the circumferential groove 35 of the ribbon take up spool 16 since the arc portion 30A has smaller radius of curvature than the circumferential groove 35. In such a condition, a small friction force acts between the arc portion 30A and the circumferential groove 35.

The bent portion 30B of the spool spring 30 abuts against the first wall 37 of the engaging slit 36 at the first extending portion side thereof, while abutting against the second wall 38 of the engaging slit 36 at the arc portion side thereof. The first extending portion 30C of the spool spring 30 is securely held in the engaging groove 31 as described previously.

If the ribbon take up spool 16 is rotated from the position shown in FIG. 7 in the ribbon take up direction C by transmitting driving force thereto from the driving shaft of the tape printing device, the bent portion 30B comes off from the engaging slit 36 easily, as shown in FIG. 8, by sliding up along the second wall 38. Accordingly, the ribbon take up spool 16 can take up the ink ribbon 13 smoothly and without hindrance.

It should be noted that, when the bent portion 30B comes off from the engaging slit 36, the radius curvature of the arc portion 30A increases as shown in FIG. 8 and the spool spring 30 comes into contact with the engaging groove 35 only at a small area of the arc portion 30A and at the tip of the bent portion 30B instead of with the entire length of the arc portion 30A. As a result, the friction that occurs between the spool spring 30 and the circumferential groove 35 decreases drastically, and the ribbon take up spool 16 can be rotated smoothly with a small driving force to roll up the ink ribbon 13.

It should be noted that the under surface of the lower brim 33 has a burr formed thereon at the time the take up spool 16 is produced from resin. This burr extends in the radial direction of the ribbon take up spool 16 and run against the second extending portion 30D as the ribbon take up spool 16 is rotated in the ribbon take up direction C. If the spool spring 30 does not have the second extending portion 30D at the end of the arc portion 30A, the burr hits a flat end face of the arc portion 30A and thereby precludes the ribbon take up spool 16 from further rotating in the ribbon take up direction C. In the present embodiment, however, the burr slides into between the arc portion 30A and the lower brim 33 since the second extending portion 30D, which comes in contact with the burr at the circumferential surface thereof, slides over the burr. As a result, the burr does not preclude smooth rotation of the ribbon take up spool 16 in the ribbon take up direction C.

At the moment of removing the tape cassette 1 from the tape printer device, the driving shaft of the tape printer device may apply force to the inner teeth 18 of the ribbon take up spool 16 that acts to rotate the ribbon take up spool 16 in the direction opposite to the ribbon take up direction C.

In such a case, the bent portion 30B of the spool spring 30 drops into one of the engaging slit 36 (see FIG. 7) and abuts against the first wall 37. Since the first wall 37 is formed so as to extend in the radial direction of the ribbon take up spool 16, the first wall 37 does not allow the bent portion 30B of the spool spring 16 to come off from the slit 36. Since the spool spring 16 is also engaged with the engaging groove 31 of the cassette case 11 and cannot rotate with the ribbon take up spool 16, the spool spring 16 engaged with engaging slit 36 prevents the ribbon take up spool 16 from rotating in the direction opposite to the ribbon take up direction C. Thus, occurrence of slack in the ink ribbon 13 is reliably prevented and the tape cassette 1 can be set again into the tape printer device without requiring removal of the slack in the ink ribbon 13.

While the invention has been described in detail with reference to specific embodiments thereof, it would be apparent to those skilled in the art that various changes and modifications may be made therein without departing from the spirit of the invention, the scope of which is defined by the attached claims.

For example, although two engaging slits 36 are formed in the engaging groove 35 of the ribbon take up spool 16 so as to face each other in the embodiment described above, the number of the engaging slits 36 that can be formed in the ribbon take up spool 16 is not limited to two. Only one or more than two engaging slits 36 may be formed in the ribbon take up spool 16.

Further, the engaging groove 31 of the cassette case 11 may be modified in many forms, including a pair of ribs 31*a* that is arranged to hold the first extending portion 30C of the spool spring 30 therebetween as shown in FIG. 9, and a tube like member 31*b* that is arranged to hold the first extending portion 30*c* inserted thereinto as shown in FIG. 10.

Further, the first wall 37 of the engaging slit 36 formed in the ribbon take up spool 16 may be obliquely formed so as to face inside the ribbon take up spool 16. Also in this case, the first wall 37 can securely engage with the bent portion 30B of the spool spring 30 and thereby prevent the ribbon take up spool 16 from rotating in the direction opposite to the ribbon take up direction C.

Alternatively, the first wall 37 may be obliquely formed so as to face outside the ribbon take up spool 16 as shown in FIG. 11.

Further, as shown in FIG. 12, the spool spring 30 may be formed so that the bent portion 30B is bent at an obtuse angle, or at an angle slightly larger than a right angle. In this case, the spool spring 30 disengages with ease from the engaging slit 36 as the ribbon take up spool 16 rotates in the ribbon take up direction.

The present disclosure relates to the subject matter contained in Japanese Patent Application No. 2002-283278, filed on Sep. 27, 2002, which is expressly incorporated herein by reference in its entirety.

What is claimed is:

1. A ribbon cassette, comprising:

a ribbon supply spool;

a ribbon take up spool that takes up an ink ribbon from said ribbon supply spool by rotating in a first rotation direction, said ribbon take up spool being provided with an engaging portion; and an engaging member disposed on the ribbon take-up spool that resiliently engages with said engaging portion to prevent said ribbon take up spool from rotating in a second rotation direction opposite to said first rotation direction, said engaging member coming off from said engaging portion when said ribbon take up spool rotates in said first direction, wherein said engaging portion includes a first and second walls, said take-up spool being prevented from rotating in said second direction as said engaging member engages with the first wall, and said take-up spool being allowed to rotate in said first direction as said engaging member slips on the second wall.

2. The ribbon cassette according to claim 1, wherein said engaging portion includes first and second walls arranged in said second rotation direction in this order, said engaging member engaging with said engaging portion by dropping into a space defined between said first and second walls, said first wall being defined along a plane including a rotation axis of said ribbon take up spool.

3. The ribbon cassette according to claim 2, wherein said second wall is formed so as to allow said engaging member to come off from said engaging portion by sliding along said second wall when said ribbon take up spool is rotated in said first rotation direction.

4. The ribbon cassette according to claim 3, wherein said second wall is inclined to face outside said ribbon take up spool.

5. The ribbon cassette according to claim 1, wherein said ribbon take up spool has substantially a cylindrical wall, and wherein said engaging portion is a slit formed through said cylindrical wall.

6. The ribbon cassette according to claim 5, wherein said cylindrical wall is provided with a plurality of said slits arranged in a circumferential direction of said cylindrical wall.

7. The ribbon cassette according to claim 1, wherein said ribbon take up spool is provided with a pair of brims, said ink ribbon being wound around said ribbon take up spool at a space defined between said pair of brims, and wherein said engaging portion is located outside said pair of brims.

8. The ribbon cassette according to claim 1, further comprising a cassette case that accommodates said ribbon supply spool and said ribbon take up spool, said engaging member being held by said cassette case and thereby prevented from rotating together with said ribbon take up spool.

9. The ribbon cassette according to claim 8, wherein said engaging member is a single wire rod including:

an arc portion that extends along a circumferential wall of said ribbon take up spool;

a linear portion formed at one end of said wire rod; and a bent portion defined between said arc portion and said linear portion so as to allow said linear portion to extend in substantially a radial direction of said ribbon take up spool, wherein said engaging member engages with said engaging portion at said bent portion and is supported by said cassette case at said linear portion so as not to rotate together with said ribbon take up spool.

10. The ribbon cassette according to claim 9, wherein said cassette case is provided with a groove for holding said engaging member.

11. The ribbon cassette according to claim 9, wherein said cassette case is provided with a tube like portion for holding said engaging member.

12. The ribbon cassette according to claim 9, wherein said cassette case having a pair of ribs for holding said engaging member.

13. The ribbon cassette according to claim 9, wherein said engaging member further includes an additional linear portion formed between said bent portion and said arc portion, said additional linear portion is bent inwardly against said arc portion.

14. The ribbon cassette according to claim 9, wherein said arc portion has a smaller radius of curvature than said circumferential wall of said ribbon take up spool.

15. The ribbon cassette according to claim 9, wherein said ribbon take up spool is provided with a circumferential groove for receiving said arc portion of said engaging member.

16. The ribbon cassette according to claim 15, wherein said arc portion has a smaller radius of curvature than said circumferential groove.

17. The ribbon cassette according to claim 15, wherein said ribbon take up spool is provided with a pair of brims, said ink ribbon being wound around said ribbon take up spool at a space defined between said pair of brims, and wherein said circumferential groove is located outside said pair of brims.

18. The ribbon cassette according to claim 9, wherein said ribbon take up spool is provided with a pair of brims, said ink ribbon being wound around said ribbon take up spool at a space defined between said pair of brims, and wherein said arc portion of said engaging member is located outside said pair of brims.

19. The ribbon cassette according to claim 18, wherein said engaging member further includes an extending portion extending from an end of said arc portion opposite from said linear portion substantially along said radial direction of said ribbon take up spool.

20. The ribbon cassette according to claim 9, wherein said arc portion is a major arc.

21. A ribbon cassette, comprising:

a ribbon supply spool;

a ribbon take up spool that takes up an ink ribbon from said ribbon supply spool by rotating in a first rotation direction, said ribbon take up spool being provided with an engaging portion; and an engaging member that resiliently engages with said engaging portion to prevent said ribbon take up spool from rotating in a second rotation direction opposite to said first rotation direction, said engaging member coming off from said engaging portion when said ribbon take up spool rotates in said first direction, wherein said engaging portion includes first and second walls arranged in said second rotation direction in this order, said engaging member engaging with said engaging portion by dropping into a space defined between said first and second walls, said first wall being defined along a plane including a rotation axis of said ribbon take up spools, said second wall is formed so as to allow said engaging member to come off from said engaging portion by sliding along said second wall when said ribbon take up spool is rotated in said first rotation direction, and said second wall is inclined to face outside said ribbon take up spool.

22. A ribbon cassette, comprising:

a ribbon supply spool;

a ribbon take up spool that takes up an ink ribbon from said ribbon supply spool by rotating in a first rotation direction, said ribbon take up spool being provided with an engaging portion; and an engaging member that resiliently engages with said engaging portion to prevent said ribbon take up spool from rotating in a second rotation direction opposite to said first rotation direction, said engaging member coming off from said engaging portion when said ribbon take up spool rotates in said first direction, wherein said ribbon take up spool has substantially a cylindrical wall, wherein said engaging portion is a slit formed through said cylindrical wall, and wherein said cylindrical wall is provided with a plurality of said slits arranged in a circumferential direction of said cylindrical wall.

23. A ribbon cassette, comprising:

a ribbon supply spool;

a ribbon take up spool that takes up an ink ribbon from said ribbon supply spool by rotating in a first rotation direction, said ribbon take up spool being provided with an engaging portion;

an engaging member that resiliently engage with said engaging portion to prevent said ribbon take up spool from rotating in a second rotation direction opposite to said first rotation direction, said engaging member coming off from said engaging portion when said ribbon take up spools rotates in a said first direction; and a cassette case that accommodates said ribbon supply spool and said ribbon take up spool, said engaging member being held by said cassette case and thereby prevented from rotating together with said ribbon take up spool, wherein said engaging member is a single wire rod including:

an arc portion that extends along a circumferential wall of said ribbon take up spool;

a linear portion formed at one end of said wire rod; and a bent portion defined between said arc portion and said linear portion so as to allow said linear portion to extend in substantially a radial direction of said ribbon take up spool, wherein said engaging member engages with said engaging portion at said bent portion and is supported by said cassette case at said linear portion so as not to rotate together with said ribbon take up spool.

24. The ribbon cassette according to claim 23, wherein said cassette case is provided with a groove for holding said engaging member.

25. The ribbon cassette according to claim 23, wherein said cassette case is provided with a tube like portion for holding said engaging member.

26. The ribbon cassette according to claim 23, wherein said cassette case having a pair of ribs for holding said engaging member.

27. The ribbon cassette according to claim 23, wherein said engaging member further includes an additional linear portion formed between said bent portion and said arc portion, said additional linear portion is bent inwardly against said arc portion.

28. The ribbon cassette according to claim 23, wherein said arc portion has a smaller radius of curvature than said circumferential wall of said ribbon take up spool.

29. The ribbon cassette according to claim 23, wherein said ribbon take up spool is provided with a circumferential groove for receiving said arc portion of said engaging member.

30. The ribbon cassette according to claim 29, wherein said arc portion has a smaller radius of curvature than said circumferential groove.

31. The ribbon cassette according to claim 29, wherein said ribbon take up spool is provided with a pair of brims, said ink ribbon being wound around said ribbon take up spool at a space defined between said pair of brims, and wherein said circumferential groove is located outside said pair of brims.

32. The ribbon cassette according to claim 23, wherein said ribbon take up spool is provided with a pair of brims, said ink ribbon being wound around said ribbon take up spool at a space defined between said pair of brims, and wherein said arc portion of said engaging member is located outside said pair of brims.

33. The ribbon cassette according to claim 32, wherein said engaging member further includes an extending portion extending from an end of said arc portion opposite from said linear portion substantially along said radial direction of said ribbon take up spool.

34. The ribbon cassette according to claim 23, wherein said arc portion is a major arc.

* * * * *